US007812245B2

(12) United States Patent
Reid

(10) Patent No.: US 7,812,245 B2
(45) Date of Patent: Oct. 12, 2010

(54) SELF POWERED HEAT TRANSFER FAN

(76) Inventor: Randall H. Reid, R#4, Wiarton, Ontario (CA) N0H 2T0

( * ) Notice: Subject to any disclaimer, the term of this patent is extended or adjusted under 35 U.S.C. 154(b) by 559 days.

(21) Appl. No.: 11/902,716

(22) Filed: Sep. 25, 2007

(65) Prior Publication Data

US 2008/0134690 A1 Jun. 12, 2008

(30) Foreign Application Priority Data

Dec. 12, 2006 (CA) ..... 2570928

(51) Int. Cl.
*F25B 21/02* (2006.01)
*H01L 35/30* (2006.01)

(52) U.S. Cl. ..... 136/205; 62/3.7

(58) Field of Classification Search ..... 136/200, 136/205; 62/3.1, 3.2, 3.7
See application file for complete search history.

(56) References Cited

U.S. PATENT DOCUMENTS

| | | | |
|---|---|---|---|
| 664,776 | A | 12/1900 | Porter |
| 1,118,269 | A | 11/1914 | Creveling |
| 2,519,241 | A | 8/1950 | Findley |
| 3,150,656 | A | 9/1964 | Huber |
| 3,602,001 | A | 8/1971 | Bauer |
| 4,296,733 | A | 10/1981 | Saunders |

(Continued)

FOREIGN PATENT DOCUMENTS

CA 2103734 C 8/1996

(Continued)

OTHER PUBLICATIONS

PCT Search Report & Written Opinion in PCT/CA2008/000873 mailed Nov. 24, 2008.

(Continued)

*Primary Examiner*—Jeffrey T Barton
*Assistant Examiner*—Allison Bourke
(74) *Attorney, Agent, or Firm*—Manelli Denison & Selter Pllc; Edward J. Stemberger

(57) ABSTRACT

A self-powered fan for circulating air for use in cooperation with a heat source, such as a wood stove, and having a first heat transfer member thermally and physically connected with the heat source. The fan blades operably create a first or warm air flow and a second or cooler air flow. The fan has a second heat transfer member with a thermocouple module structure located between the two heat transfer members. The first heat transfer member is of suitable material, size, mass and shape as to provide a suitable temperature gradient between the thermocouple structure and the heat source to operably allow of such sufficient heat transfer from the first heat transfer member to the thermocouple to generate sufficient power to effect rotation of the blades, but not to cause thermal damage to the thermocouple structure. The fan blades are constructed and arranged to cause a portion of the second air flow to be drawn past the first heat transfer member to effect a cooling heat transfer effect upon the first heat transfer member. The improvement is wherein the motor located on the first transfer member adjacent a side of the thermocouple structure remote from the second transfer member does not hinder the second air flow, and is suitably located as to not be operably thermally damaged by the first heat transfer member or the heat source.

5 Claims, 9 Drawing Sheets

U.S. PATENT DOCUMENTS

| | | | | |
|---|---|---|---|---|
| 4,472,945 | A | 9/1984 | Cech et al. | |
| 4,843,273 | A | 6/1989 | Dammers et al. | |
| 5,544,488 | A | 8/1996 | Reid | |
| 6,019,098 | A | 2/2000 | Bass et al. | |
| 6,588,419 | B1 | 7/2003 | Beuzis et al. | |
| 2005/0263177 | A1* | 12/2005 | Bell | 136/224 |
| 2007/0095378 | A1* | 5/2007 | Ito et al. | 136/203 |

FOREIGN PATENT DOCUMENTS

| | | | |
|---|---|---|---|
| JP | 6298149 | A | 10/1994 |
| JP | 2001221508 | A | 8/2001 |

OTHER PUBLICATIONS

Tellurex Corporation, "The 12 Most Frequently Asked Questions About Thermoelectric Power Generation", Aug. 24, 2007, <URL:http://www.tellurex.com/12most2.html>.

"Tellurex Thermoelectric (TE) Demonstration Devices", Tellurex Corporation (not dated).

* cited by examiner

SELF POWERED HEAT TRANSFER FAN

FIELD OF THE INVENTION

This invention relates to heat transfer fans, particularly to such fans for use in conjunction with cooled or heated surfaces, and more particularly, with fossil-fuel burning stoves.

BACKGROUND OF THE INVENTION

Heating units such as wood and other fossil-fuel combustible material burning stoves, hot water radiators and the like disseminate heat into surrounding space by radiation and by convection of thermal air currents circulating around the unit. Warm air distribution from the unit may be enhanced by means of an air blower or fan suitably placed on or adjacent the unit. Presently, such air circulating fans are powered by electric battery or mains power supply.

It is known through the so-called "Peltier Effect" that when a direct electric current is passed through a thermoelectric couple, heat will be absorbed at one end of the couple to cause cooling thereof, while heat is rejected at the other end of the couple to cause a rise in temperature. By reversing the current flow, the direction of heat flow will be reversed.

Thermoelectric modules are forms of a thermoelectric couple and, typically, comprise an array of semiconductor couples (P and N pellets) connected electrically in series and thermally in parallel, sandwiched between metallized ceramic substrates.

In a reverse manner, by the so-called "Seebeck Thermocouple Effect", a thermoelectric module behaves like a simple thermocouple in generating an electric potential across its terminals if a temperature gradient or thermocline is provided across the module when in an open circuit mode. Thus, electric power is generated as a function of the temperature difference between both ends of the module.

Pertinent prior art comprises a demonstration model of a power generation module powering an air circulation fan disclosed by Tellurex Corporation, Michigan, U.S.A. The Tellurex Corporation self-powered fan comprises a hot end heat exchanger heated by a hand-held propane torch, electric motor, fan blades, a cold end heat exchanger and a thermoelectric module sandwiched in thermal contact between the two heat exchangers and in electric contact with the electric motor. In this demonstration model, the module is heated by a propane torch to merely demonstrate current generation while requiring a hand held pyrometer to prevent overheating and destruction of the module. It is clear from this demonstration model that it could not be satisfactorily and reliably used to circulate heat from a hot surface, since sufficiently high temperatures of the hot surface sufficient to provide an effective air circulation effect would cause the thermoelectric module to simply overheat and be destroyed. Further, the orientation of the fan and the cool end heat sink are so located relative to the heat source as to cause passage of the hot gases on the hot side of the thermoelectric module around and through the cool end heat sink. Thus, the Tellurex Corporation demonstration model has no practical and reliable utility as a warm air circulating fan if placed on a heated surface.

U.S. Pat. No. 5,544,488, issued Aug. 13, 1996 to Reid, Randall H. describes an air circulation fan powered only by a thermoelectric module obtaining heat available at the heated surface of a heating unit, such as the top of a stove, can provide useful warm air circulation, notwithstanding the extremely low efficiency of conversion of thermal energy to electrical energy inherent in the aforesaid Seebeck Thermocouple Effect. U.S. Pat. No. 5,544,488 teaches that by judicious selection of components and the physical arrangement of these components to constitute a hot air circulation fan suitable efficacious warm air circulation is reliably and safely obtained. Thus, not only is warm air propelled forward from the unit to provide warm air circulation but that incoming cooler air pulled by the fan operates to enhance cooling of the heat sink cool end and, when appropriate, the hot end of the thermocouple module to provide reduced risk of damage through overheating of the thermocouple module.

Further, U.S. Pat. No. 5,544,488 teaches that an air circulation fan powered only by a thermoelectric module cooled at the cooling surface of a cooling system, such as, for example, provided by ice/water or a refrigeration system can provide useful air circulation, notwithstanding the extremely low efficiency of conversion of thermal energy to electrical energy inherent in the Seebeck Thermocouple Effect. Judicious selection of components and the physical arrangement of these components to constitute an air circulation fan suitable efficacious air circulation is reliably and safely obtained There is, however, a need for such self-powered heat transfer fans having improved performance characteristics.

SUMMARY OF THE INVENTION

It is an object of the present invention to provide an improved practical air circulation fan which generates its own electrical power from a temperature difference induced across distinct members of the fan.

It is a further object of the present invention to provide an improved air circulation fan which generates its own electrical power from an external heat source for use with such heat source, for example a fossil-fuel burning stove.

It is a yet further object of the present invention to provide an improved fan having heat transfer means controllable by the cooling assistance of the fan blades.

These and other advantages and objects of the present invention will become apparent upon a reading of this specification taken in conjunction with the accompanying drawings.

Accordingly, the invention provides a self-powered fan for circulating air for use in cooperation with a heat source, said fan comprising a first heat transfer member having a first heat transfer surface thermally and physically connected with said heat source, electric motor, fan blades which operably create a first or warm air flow and a second or cooler air flow, a second heat transfer member having a second heat transfer surface, thermocouple structure located between said first heat transfer member and said second heat transfer member, wherein said thermocouple structure co-operable with said motor, said first heat transfer member and said second heat transfer member, wherein said first heat transfer member being of suitable material, size, mass and shape as to provide a suitable temperature gradient between said thermocouple structure and said heat source to operably allow of such sufficient heat transfer from said first heat transfer member to said thermocouple structure to generate sufficient power to effect rotation of said blades, but not to cause thermal damage to said thermocouple structure; and wherein said fan blades are constructed and arranged to cause a portion of said second air flow to be drawn past said first heat transfer surface to effect a cooling heat transfer effect upon said first heat transfer member, the improvement comprising said motor located on said first transfer member adjacent a side of said thermocouple structure remote from said second transfer member, whereby said motor does not hinder said second air flow, and is suitably located as to not be operably thermally damaged by said first heat transfer member or said heat source.

In preferred embodiments, the invention provides a self-powered fan for circulating air in combination with a heat source having a heated surface, said fan comprising:

a base portion having a surface constructed and arranged to contact the heated surface of the heat source, a heat transfer portion extending from said base, said heat transfer portion having first and second ends, said first end being coupled to said base, a thermoelectric module having first and second end surfaces, said first end surface being mounted on said second end of said heat transfer portion such that said heat transfer portion conducts heat to said thermoelectric module, heat exchange structure mounted on said second end surface of said thermoelectric module so as to control an amount of heat conducted at the top said thermoelectric module, an electric motor electrically coupled to said thermoelectric module, and fan blades coupled to said electric motor, wherein said heat transfer portion is constructed and arranged to provide a suitable temperature gradient between said thermoelectric module and said heat source to allow sufficient heat transfer from said heat transfer portion to said thermoelectric module to generate sufficient power to said motor to effect rotation of said blades without causing thermal damage to said thermoelectric module, said fan blades being constructed and arranged relative to said base portion and heat transfer portion to cause a portion of ambient air flow to be drawn past said base portion and heat transfer portion effecting cooling of said base portion; the improvement comprising said motor suitably located at said second end of said heat transfer portion adjacent said first end surface of said thermoelectric module as to not be operably thermally damaged by said heat transfer portion or said heat source and remote from said heat exchange structure whereby said motor does not hinder a portion of ambient airflow to be drawn past said heat exchange structure.

The invention is of particular value when the heat transfer means comprises a base of the fan which rests upon the top of or is adjacent in contact with a heat source such as a fossil-fuel burning stove, for instance a coal fired or wood burning stove.

The fan according to a preferred aspect of the invention is a device to circulate warmed air from the hot stove surface. The fan uses the difference in temperature between the hot surface of the stove upon which the fan is resting and the surrounding air to power the fan. The power is derived by utilizing a thermoelectric module, preferably consisting of an array of thermocouples. The current generated is used to power a d.c. motor which operates the fan blades to circulate warm air and maintain the temperature difference across the thermocouple. The fan draws all of its power from the heated surface and requires no external electrical power source. Most importantly, the fan stops, starts and runs automatically and provides variable air circulation in proportion to the amount of heat provided to the hot side heat exchanger base and resultant thermocline across the thermocouple module.

By suitable selection of material and the surface area, size, mass and shape of the hot end heat exchanger, suitable temperature gradients between the thermocouple module and the stove can be obtained to operably allow sufficient heat to reach the hot end of the module, without destroying it, and to generate sufficient power to effect rotation of the fan blades. Such suitable determination of material, surface area, size, mass and shape may be readily determined by the skilled person in the art.

Further, more preferably, the hot end heat exchanger comprises a base, which operatively abuts the heat source, and a heat conductive member having a length connecting with the thermocouple for transferring heat thereto. The length of this member is so chosen as to be sufficient as to provide a suitable temperature gradient between the heat source and the thermocouple as to effect blade rotation without damage of the thermocouple by overheating.

To enhance efficiency of the fan in providing warm air circulation and enhanced safety in preventing overheating of the thermocouple module, the fan blades are, preferably, so oriented relative to the hot end heat transfer base as to cause a portion of the ambient air flow to be drawn past the hot end heat transfer base in order to effect a cooling heat transfer effect upon the base. Clearly, it can be seen that the greater the temperature gradient across the module caused by an increase in temperature of the heated base, the greater the power generated with commensurate fan speed. Increased fan speed causes faster air flow around the fan and base to enhance cooling of the latter. Thus, this cooling effect constitutes a useful safety feature.

Preferably, the axis of rotation of the fan is angularly displaced, most preferably perpendicularly, to the hot and cold heat transfer means and module.

Also, preferably, the cool end heat exchanger comprises a plurality of cooling vanes dissipating heat from the module. It is highly desirable that the vanes are so disposed relative to the fan blades that the vanes extend through the cool air low stream generated by the rotation of the fan blades. In one embodiment according to the invention the cooling vanes are so disposed one vane to another as to take the form of a fan-shaped array.

Thus, the fan blades are so shaped and located relative to the module and heat exchange means as to cause cooler air to pass adjacent to and/or through the heat sink cool end. In an alternative embodiment of the invention, the fan may have a protective wire frame or shroud to prevent physical injury, and which also is connected to the module to act as a cool end heat exchanger to dissipate heat from the module.

The heat exchanger members of the fan may be formed of any suitable material, such as a metal or metal alloy, for example of aluminum, copper and iron.

Hence, fans according to the invention, can provide satisfactory air circulation when the fan module is operative at a temperature gradient of the order of as low as 30° C.

BRIEF DESCRIPTION OF THE DRAWINGS

In order that the invention may be better understood preferred embodiments will now be described, by way of example only, with reference to the accompanying drawings, wherein.

DETAILED DESCRIPTION OF PREFERRED EMBODIMENTS

Figure 1:
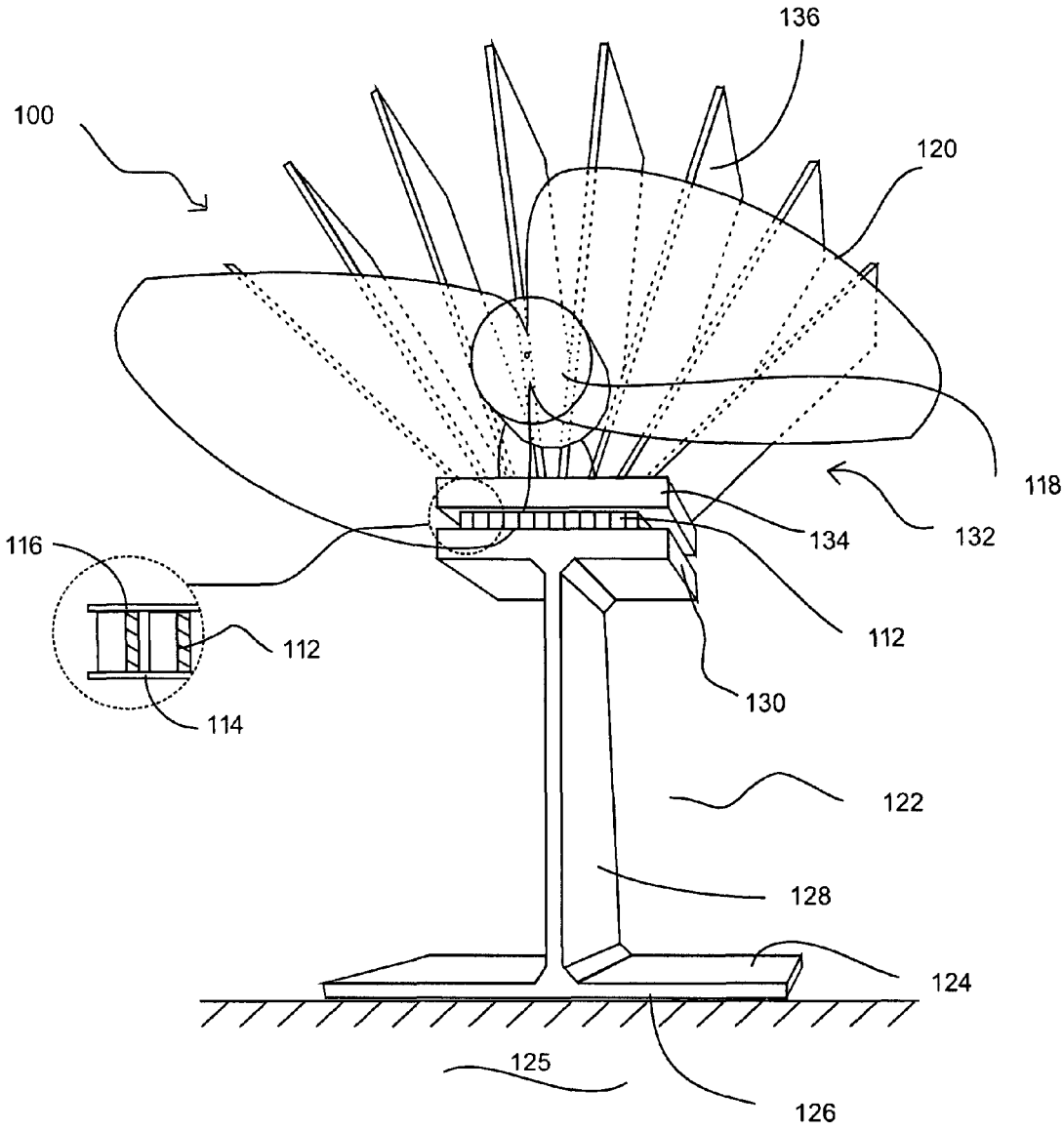
Fig. 1 (Prior Art)
FIG. 1 represents a schematic isometric view of a prior art thermocouple-powered fan.
Figure 2:
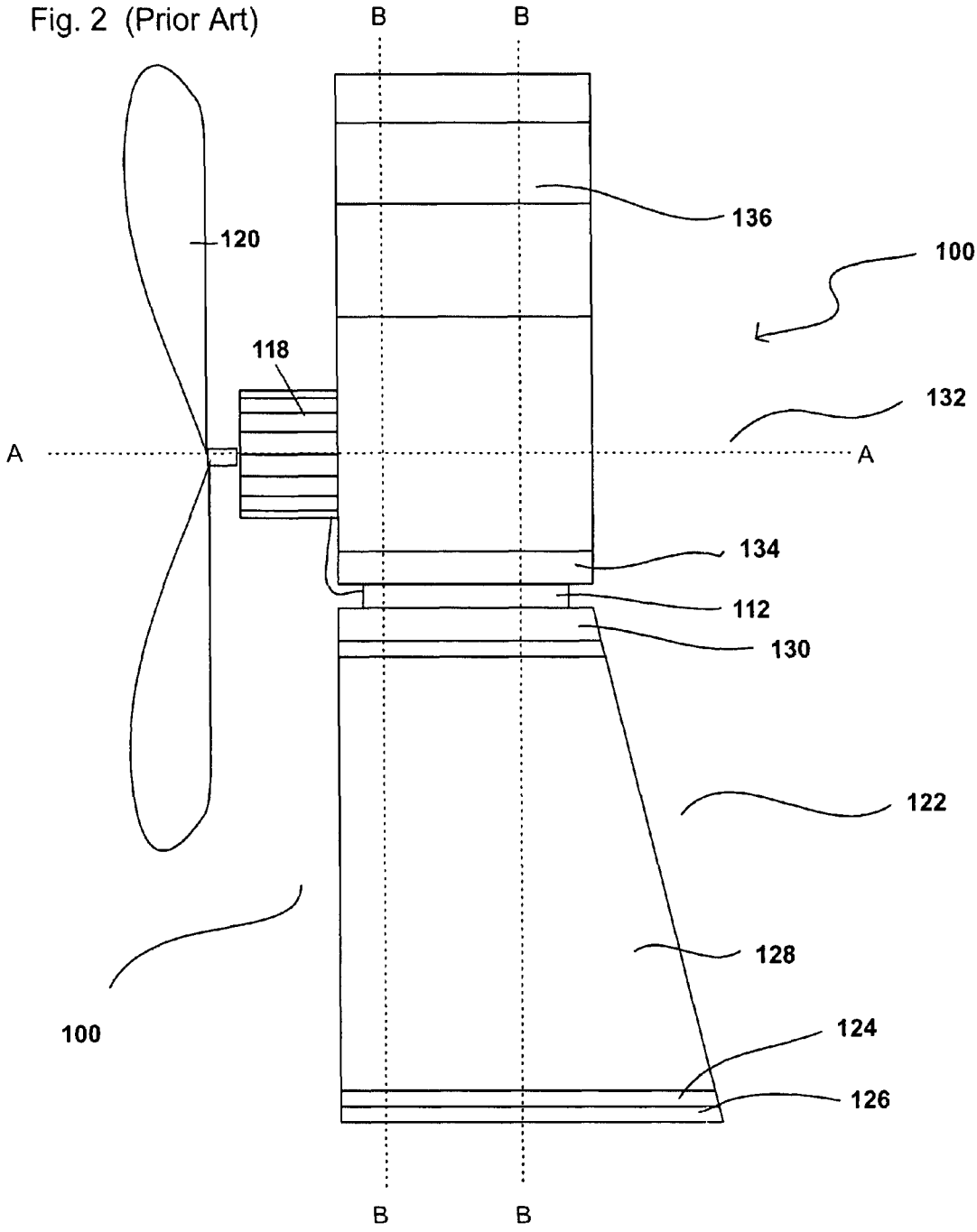
Fig. 2 (Prior Art)
FIG. 2 represents a schematic side view of the fan shown in FIG. 1, according to the prior art.

With reference to FIGS. 1 and 2, fan 100 of the prior art exemplified by U.S. Pat. No. 5,544,488 comprises a TE module 112 (cpl. 0-127-08L Melcor Frigichips, U.S.A.) comprised of an array of semiconductor couples (P and N pellets) connected electrically in series and thermally in parallel sandwiched between metallized ceramic substrates 114 and 116 according to the prior art. This module 112 can withstand temperatures only up to about 80.degree. C. Module 112 has an electrical connection with motor 118, which, drives fan blades 120, shown in outline only for clarity.

Fan 100 has a heat transfer member, shown generally as 122 having a rectangular-shaped base portion 124 having a lower surface 126 in operable contact with a heated surface of a stove or the like 125. Upstanding from rectangular base member 124 is an integrally formed vertically aligned planar heat transfer portion 128 upon which is an integrally formed heat transfer portion 130. Member 122 is, thus, constituted by integrally formed portions 124, 128 and 130 formed of aluminum. Portion 130 is in thermal communication with the lower ceramic member 114 of module 112.

Above module 112 and in thermal communication therewith is a cool end heat exchanger 132 formed of aluminum and consisting of a base 134, connected to module 112, and an array of vanes 136.

Portion 128 is so shaped as to provide the necessary heat control of heat from portion 124 to module 112, irrespective of the temperature, within reasonable limits, of the stove 125 heat source, as hereinafter more fully explained. Stove temperatures of up to, for example, 500° C. may be obtained in practice and acceptable to fans.

Thus, the mass and shape of base 124 and the distance or length, mass and shape of 128 between base 124 and module 134 is such as to provide a suitable temperature gradient between base 124 and module 134 as to cause sufficient current generation for desired fan rotation without damage of module 134 by heat when the heated stove surface 125 is at a temperature of not greater than 500° C.

Figure 3:
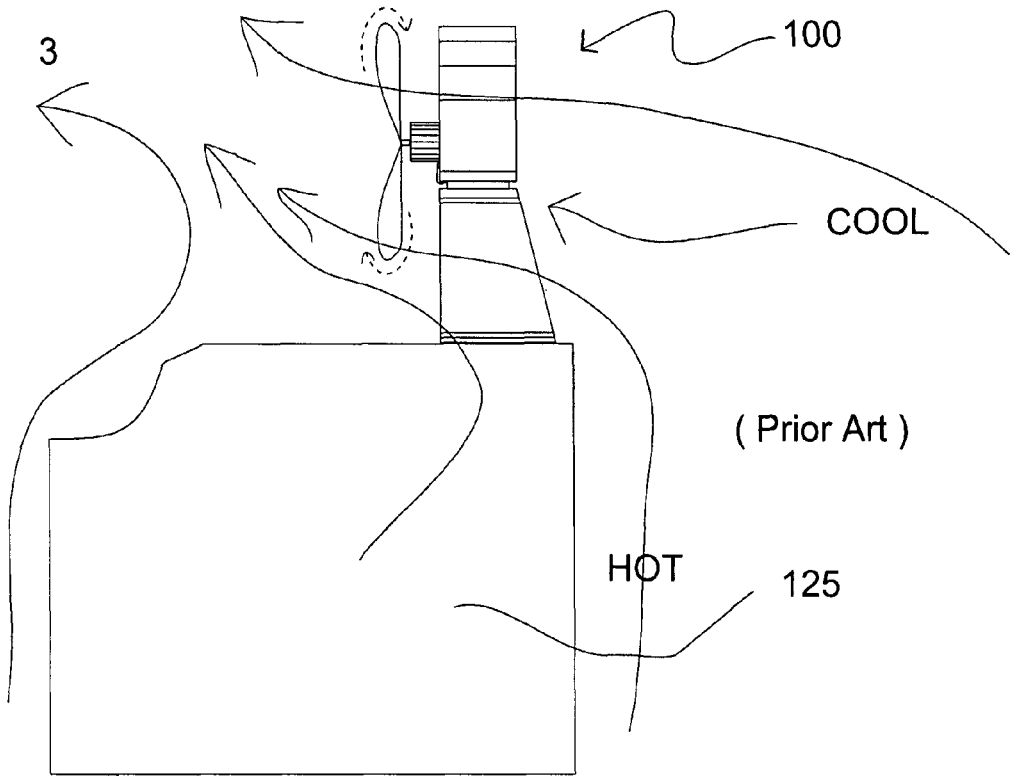
FIG. 3 represents a schematic side view of the fan shown in FIGS. 1 and 2 according to the prior art on top of a stove with a low fire and showing expected air flows.
Figure 4:
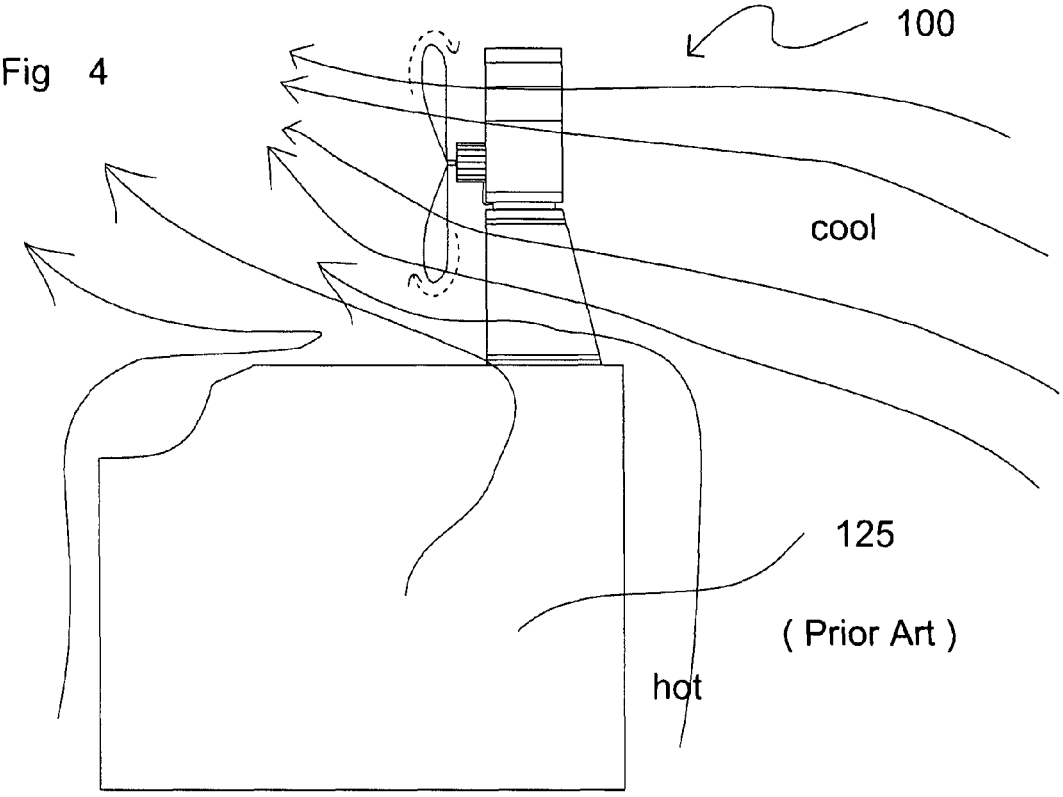
FIG. 4 represents a schematic side view of the fan according to the prior art on top of a stove with a high fire and showing expected air flows.

Reference is now made to FIGS. 3 and 4, which show fan 100 on top of a stove 125.

FIG. 3 depicts gentle air circulation created by stove 125 having a low fire and, thus, low heat transfer therefrom to module 112, via heat transfer member 122. In this situation, low power generation occurs due to a relatively small thermocline. Thus, fan 100 produces a gentle air circulation that bends the superheated air from the convection stream and sends it forwards into the area in front of stove 125. The airflow is sufficient to bring cool room temperature air through the coolside heat exchanger to maintain a thermocline across module 112 and produce enough current to maintain an adequate air circulation. The superheated convection currents are allowed to pass the base, or hotside heat exchanger and maintain as large a thermocline as is necessary.

FIG. 4 depicts air circulation created by stove 125 having a high fire. The increase in heat provided by the high fire provides more current for fan 100 and the resultant air passing through fan 100 increases greatly. The superheated air from convection is now being pushed rapidly across the stovetop and cool room temperature air flows through the coolside exchanger as in the earlier example, and is also drawn past the hotside exchanger. This latter process is absolutely critical to the operation of the unit as it strips heat from the hotside exchanger before it reaches module 112 and keeps module 112 well within operational tolerances with regard to temperature. Thus, provided that the shape, mass, size and material composition of heat transfer member 122 is suitable selected, efficient cooling of member 122 by the rapid cool air flow will prevent excess heat transfer to and damage of module 112.

It can be seen that motor 118 of fan 100 is located adjacent the cold side of heat exchanger 132 of module 112, above module 112, i.e. on the side remote from heat transfer portion 130 in the embodiment shown in FIGS. 1 and 2.

In operation, when fan 100 is placed on a hot surface, commonly a wood stove 125, heat is transferred to the base 126 from the stove surface and is conducted by stem 128 to the lower module land portion 130 and through thermoelectric module 112 to the upper module land portion 134 and is dissipated to the surrounding air by vanes 136. This creates an electrical current in module 112 that drives motor 118 and turns propeller 120 to create the desired warm air flow into the room and to draw the cooler air from behind stove 125 through vanes 136 to further aid the heat dissipation and increase current developed in motor 118.

This arrangement works well enough but has several drawbacks. It is difficult to assemble as the motor mount, assembly screws, insulators (not shown) and module 112 must all be connected and properly torqued at the same time. Additionally, the upper exchanger must be designed to maximize the vane surface area where the airflow is the greatest, which limits the design possibilities, creates a longer path for the heat to flow from the upper module land 134 to the end of vanes 136 and the fan motor 118 blocks the airflow through the most effective area of the upper heat exchanger.

Figure 5:
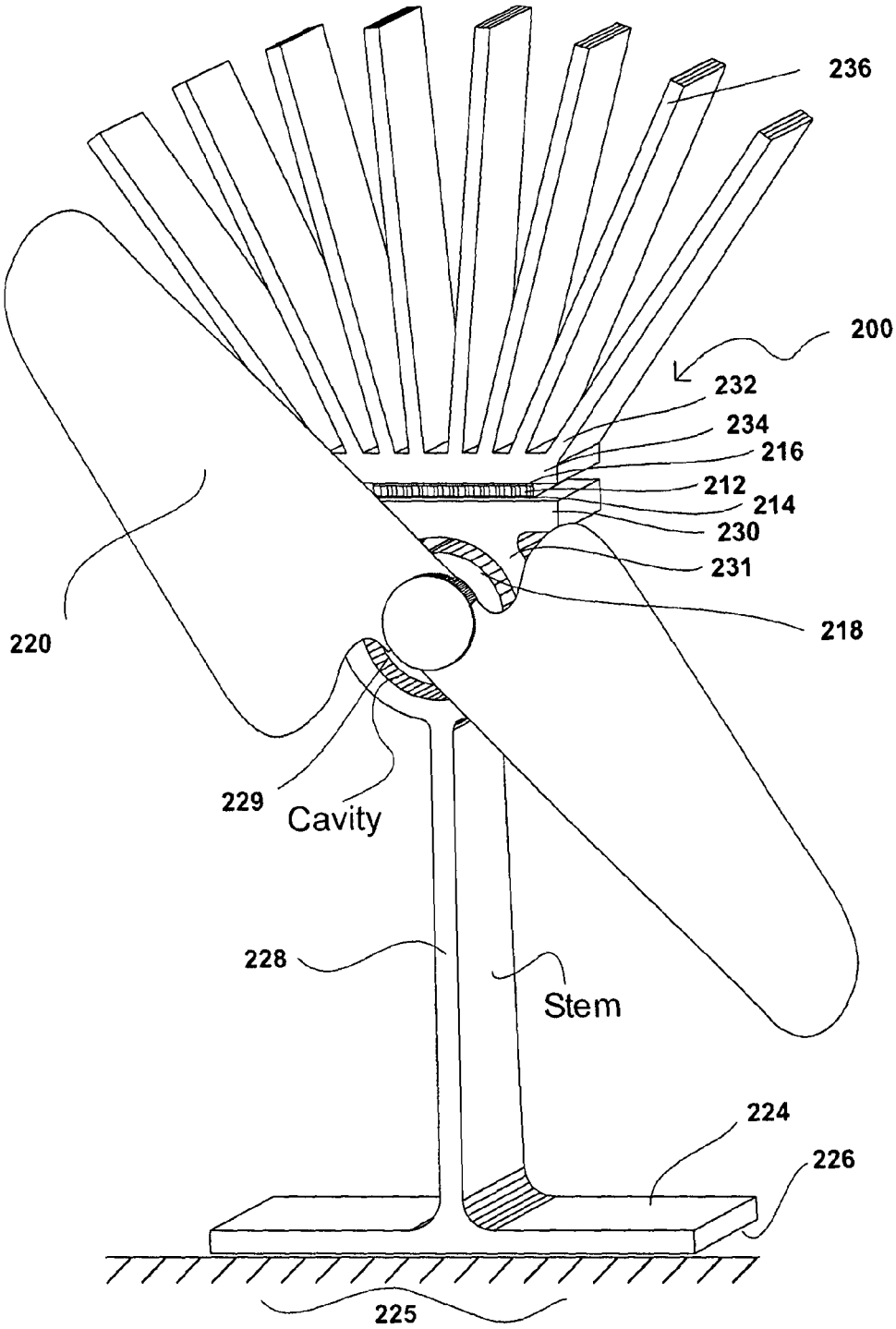
FIG. 5 represents a schematic isometric view of a thermocouple-powered fan, according to the invention.
Figure 6:
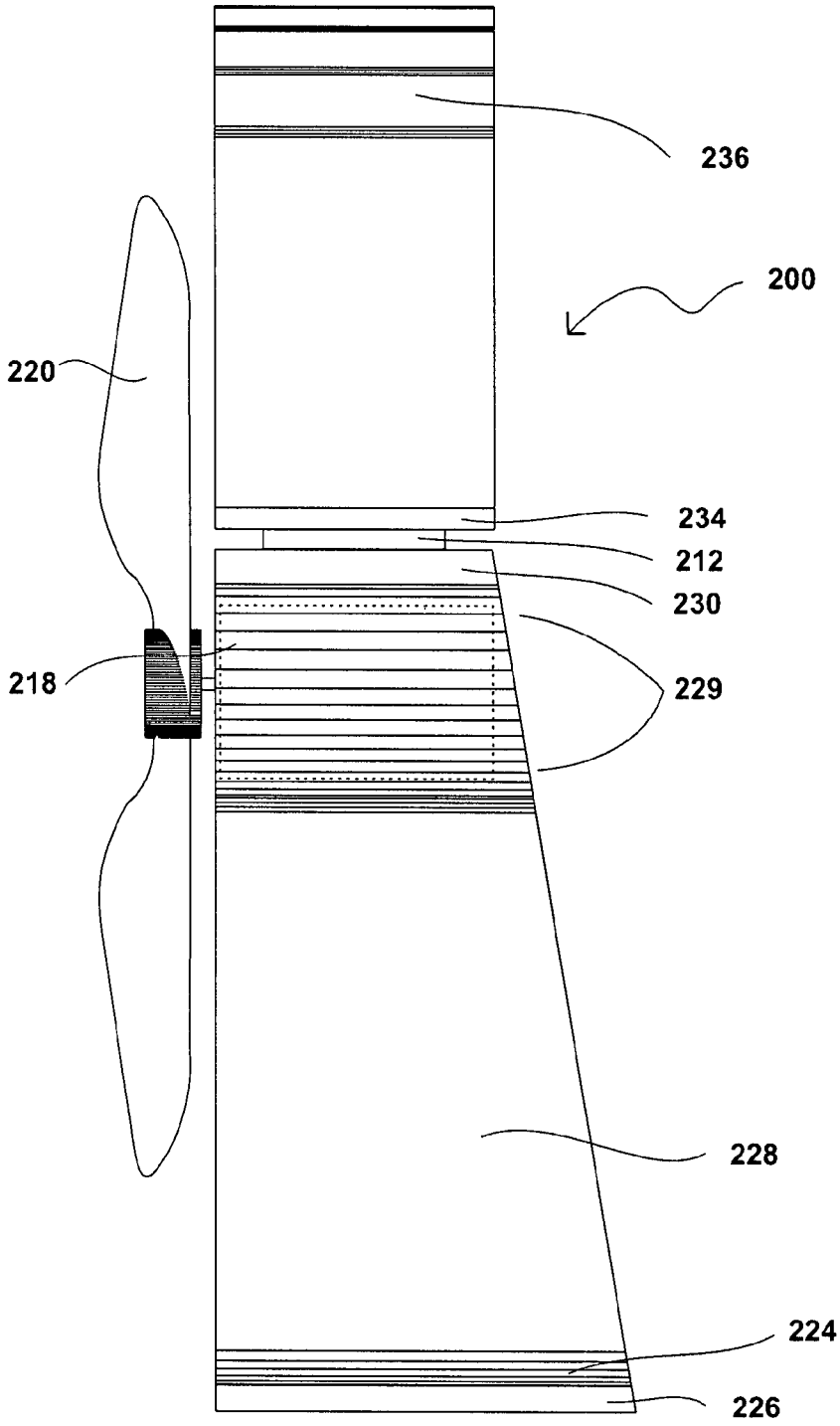
FIG. 6 represents a schematic side view of the fan shown in FIG. 5, according to the invention.

With reference now to FIGS. 5 and 6 which show, generally as 200, a preferred embodiment according to the invention, wherein the length of planar heat transfer stem portion 228 is integrally formed with an enlarged heat transfer portion 231 which is in thermal communication with the lower ceramic member 214 of module 212, itself in communication with upper ceramic member 216, and, thus, cool end heat exchanger 232 consisting of base 234 and an array of vanes 236. Base 224, stem 228 and hot and cold heat exchanger portions 230, 234, respectively, and vanes 236 are formed of aluminum.

Enlarged heat transfer portion 228 has a housing portion 231, which defines a cylindrical aperture 229, which receives and retains motor 218. This arrangement provides motor 218 to be mounted in portion 231 below lower module land 230 and, thus, below module 214.

Thus, motor 218 is located on the side of module 214 remote from cool end heat exchanger 232.

Cavity 229 in this embodiment is defined as a full depth cylindrical aperture, but may in less preferred embodiments be a suitably sized and shaped recess. Motor 218 is housed in housing portion 231 by any suitable means (not shown).

Some advantages provided by the relocation of the motor according to the invention, includes that the cool heat exchanger 232 facilitates assembly and allows a greater range of shapes of the upper exchanger to be used, provided exchanger 232 has suitable surface areas for thermal conductivity and radiation.

Figure 7:
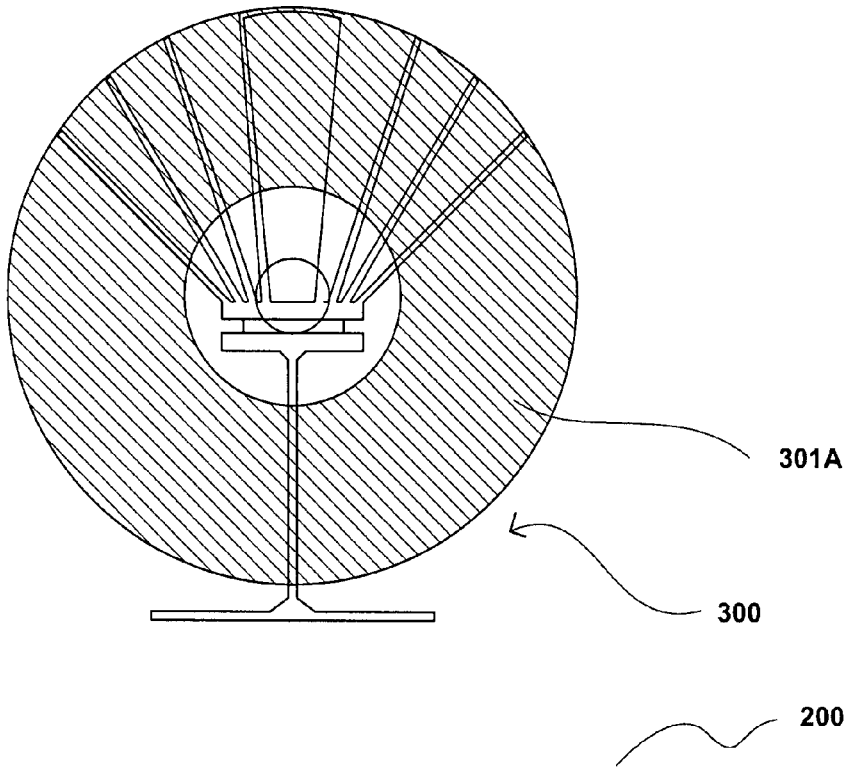
FIGS. 7 and 7A represent a schematic front view of a fan, in part without blades, superimposed with a hatched area representing the most effective airflow area and side view, respectively, according to the prior art.
Figure 7A:
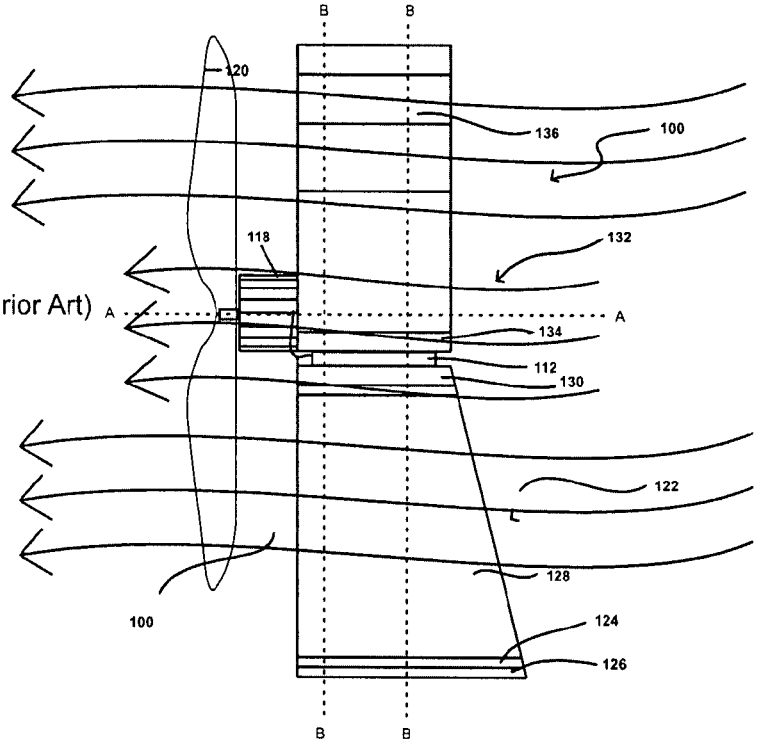
Fig. 7a (Prior Art)

Further, although the location of motor 118 of the aforesaid prior art impedes, somewhat, the air flows seen in FIGS. 3 and 4 through vanes 136, the resultant air turbulence was thought to enhance the air/vanes heat exchange interaction, as to negate any drop off in efficiency. However, I have found that relocating motor 218 to the side of module 214 remote from upper cool heat exchanger 232, results in the airflow through the latter to be much greater as it is now in line with the most effective area of the propeller sweep. This has resulted in an increased temperature drop across module 214 and more power delivered to motor 218 and enhanced rotational speed of propeller 236. FIG. 7 shows the front view of prior art fan 100 superimposed with a hatched area 301A that shows the most effective airflow area. FIG. 7*a* represents a side view of prior art fan 100 with arrows showing the airflow in cross section. The longer arrows show the most effective airflow area.

Figure 8:
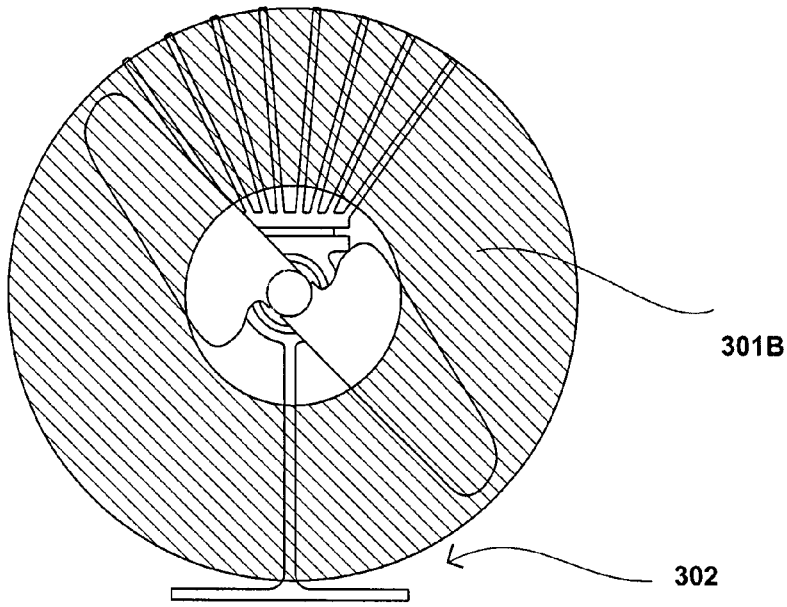
( Prior Art ) Fig 8
FIGS. 8 and 8A represent a schematic front view of a fan superimposed with a hatched area representing the most effective airflow area and side view, respectively, according to the invention.
Figure 8A:
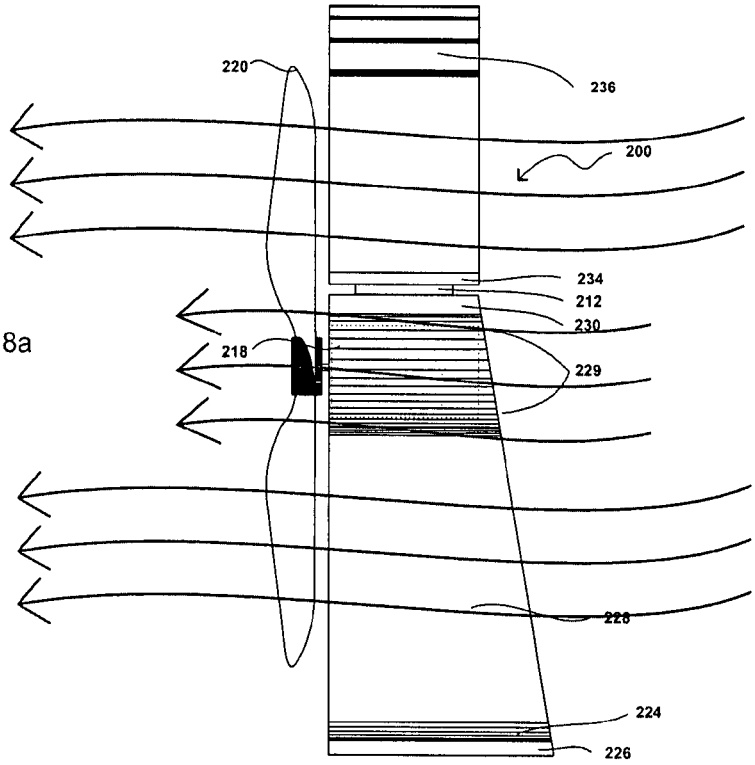

FIG. 8 shows improved design 302 according to the invention with the same hatched area 301B superimposed. FIG. 8*a* represents a side view of fan 200 with arrows showing the airflow in cross section. The longer arrows show the most effective airflow area. As can be seen, motor 118 blocks the most effective part of the old design upper exchanger 132 whereas the new location of motor 218 of the invention virtually unimpedes the upper air flows. Additionally, the lesser airflow in the fan 200 is drawn through and past aperture 229 of motor 218, which cools motor 218 and increases the cooling of lower exchanger 228.

In more preferred embodiments of the invention, stem 228 is of a relatively longer length than heat exchanger stem portion 118 of prior art FIG. 1 embodiment, whilst other fan dimensions are substantially the same. The longer stem 228 creates a longer path for the heat to travel to the lower module land 230 and increases the surface area in consequence of which overheat bimetallic lifters or screws used in the embodiments of prior art of aforesaid U.S. Pat. No. 5,544,488 are no longer required. Such bimetallic lifters or screws are required to raise the fan base from the stove surface when the stove top exceeds the temperature range that will damage the module, if exceeded. With the preferred stem and motor arrangement of the present invention and base exchanger, such overheat lifters are no longer required as enough heat is dissipated from the base and stem to protect the module through extreme heat.

Yet further, in preferred embodiments as shown in FIGS. 5 and 6, the motor is now shielded from the direct radiant heat from the stove top and runs much cooler and prevents the bearings lubrication from drying out as quickly. Motor 218, in preferred embodiments when located within aperture 229 is protected from overheating from the heat present in upper stem portion 231, by cool air flow through aperture 229 around motor 218.

Figure 9:
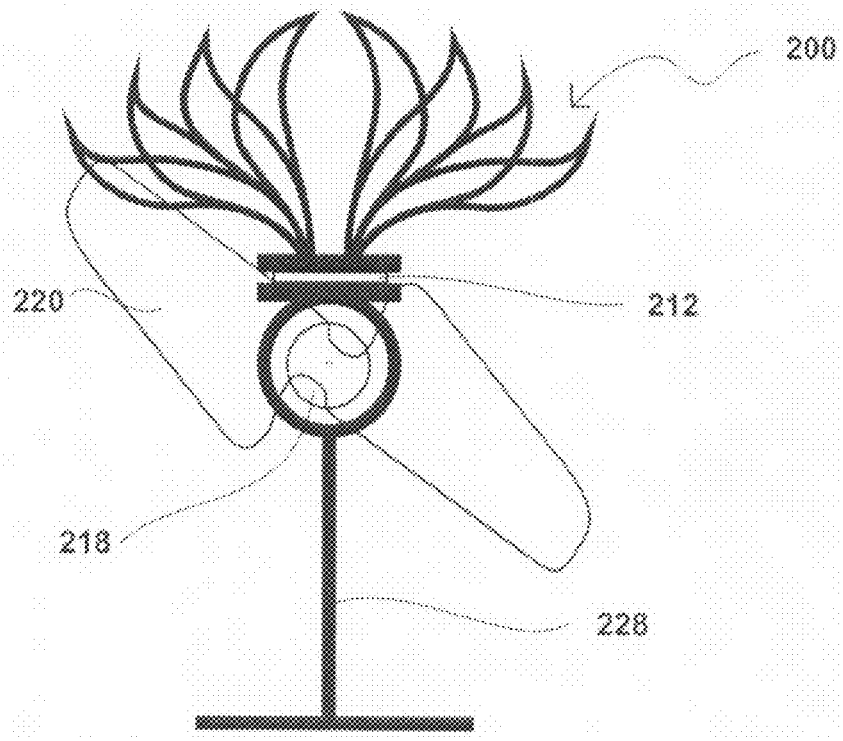
FIGS. 9 and 10 represent diagrammatic front views of fans according to the invention having upper cool heat exchanger units of various shapes and sizes.
Figure 10:
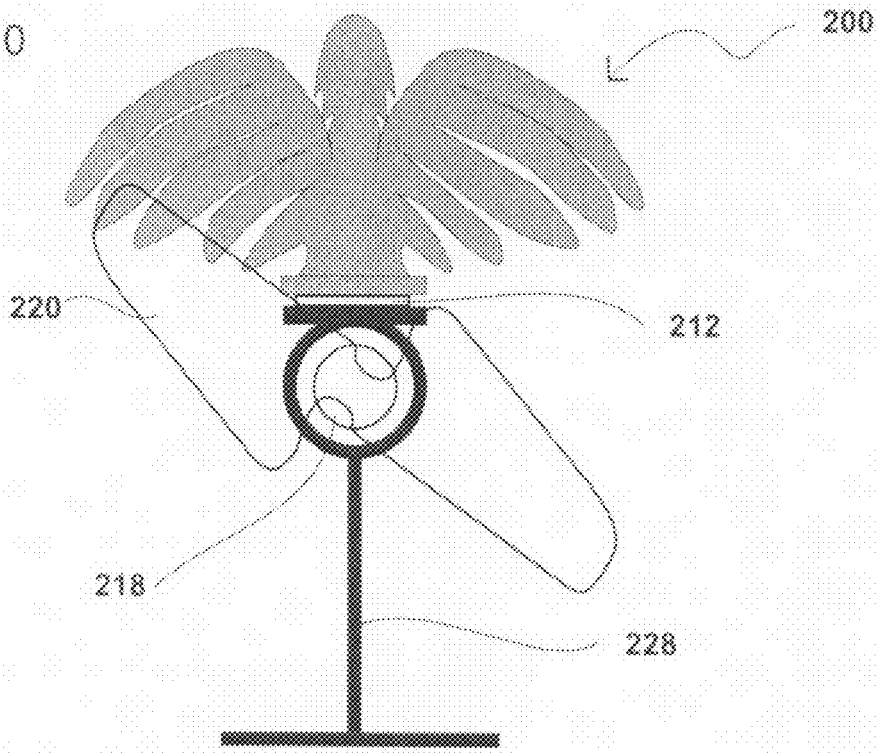

Another advantage of the fans of the present invention is that any upper heat exchanger 232 can be used without the need to redesign the lower unit 228, providing it has appropriate conductivity and sufficient swept surface area. Additionally, unit 232 is not limited to extruded parts, but could also use cast pieces to add many more design categories. Shapes in the form of, for example, birds, flags, flowers and other sorts of known or abstract shapes is now possible to address different markets. Such embodiments are shown in FIGS. 9 and 10.

Figure 11:
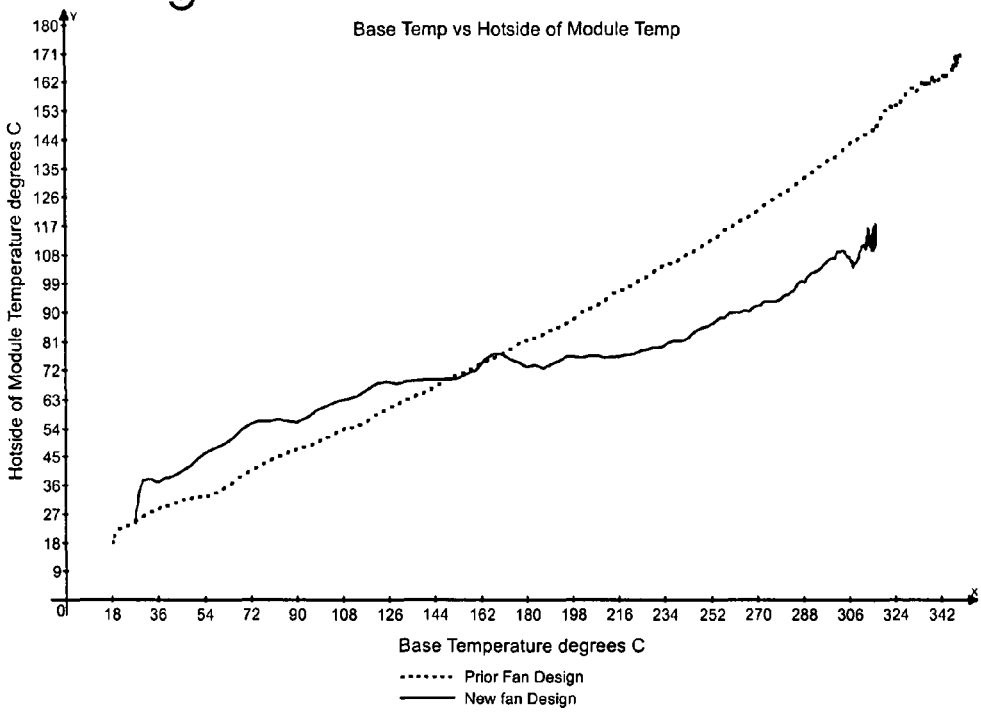
FIG. 11 represents graphs of comparative base modular hot side temperatures of fans according to the prior art (A) and the invention (B)

FIG. 11 represents comparative graphs of the base temperatures plotted against the temperatures of the lower module contact surface 130 according to the prior art (A) and 230 according to the invention (B). It can, surprisingly, be clearly seen that the module used in the invention fan runs much cooler. At a base temperature of 302° C. the invention fan 200 showed 108° C. while prior art fan 100 was at 142° C. At a base temperature of 148° C. the module hot exchanger of the prior art fan reached 170° C. Fan 200 sinks much more heat from the stove surface so that the base could not be heated beyond 318° C., at which temperature the module side of the heat exchanger reached 112° C.

Figure 12:
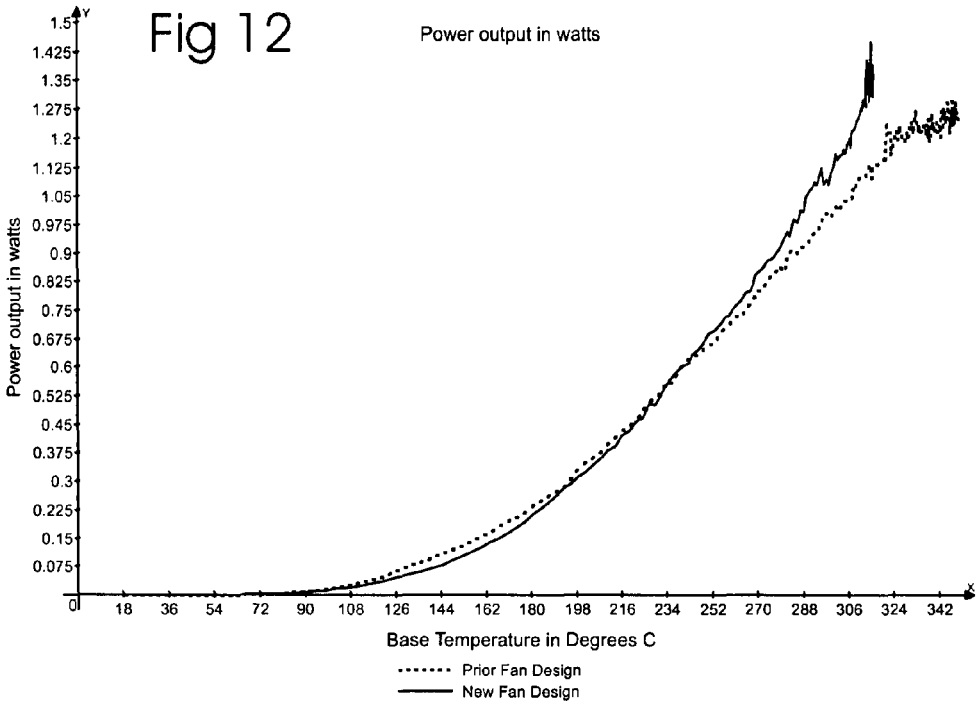
FIG. 12 represents graphs of comparative power outputs against base temperatures of fans according to the prior art (A) and the invention (B); and wherein the same numerals denote like parts.

FIG. 12 represents comparative graphs of the base temperatures against the power output from the modules in watts. Both fans carried identical motors. Up to approximately 250° C., the output was virtually the same. However, from that point upwards, surprisingly, the curves diverge. At a base temperature of 318° C., the prior art fan 100 developed 1.145 watts, while fan 200 developed 1.385 watts, i.e. over 20% higher than the prior art fan 100. Again, while the test equipment consisted of a 10,000 BTU propane heater, the base temperature did not rise beyond 318° C. in fan 200 as it was stripping the heat from the test surface. As an aside, it should be noted that the bi-metal overheat protection strip was not present in fan 100 or the comparative gains would have been much greater. Although the current generation of TE modules from Tellurix® and Melcor® company suppliers can withstand 200° C., the motors cannot stand 80° C. and the stress on connectors and the modules is much greater as the temperature rises. Accordingly, the new fan 200 is, surprisingly, both more powerful and more durable than prior art fan 100.

Unexpected benefits resulting from the relocation of the fan motor below the module and, in preferred embodiments, housed in an aperture in an upper portion of the fan stem, includes the following.

1. The fan blades are now closer to and sweep the entire cooler upper heat exchanger unit and results in enhanced cool airflow through this unit and resultant higher temperature drop across the module for improved module efficiency, more power and increased blade speed;

2. The heat path to the lower module is longer and swept by the full length of the blade so no lifters are required to stay within the limits of the module.

3. The motor is protected from the direct radiant heat of the stove and runs cooler.

4. The same base can be used for any upper exchanger which will lower production costs and make a more marketable product.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

The invention claimed is:

1. A self-powered fan for circulating air for use in cooperation with a heat source, said fan comprising a first heat transfer member having a first heat transfer surface thermally and physically connected with said heat source; an electric motor; fan blades which operably create a first or warm air flow and a second or cooler air flow; a second heat transfer member having a second heat transfer surface; and thermocouple structure located between said first heat transfer member and said second heat transfer member; wherein said thermocouple structure is co-operable with said motor, said first heat transfer member and said second heat transfer member, wherein said first heat transfer member is of suitable material, size, mass and shape as to provide a suitable temperature gradient between said thermocouple structure and said heat source to operably allow of such sufficient heat transfer from said first heat transfer member to said thermocouple structure to generate sufficient power to effect rotation of said blades, but not to cause thermal damage to said thermocouple structure, and wherein said fan blades are constructed and arranged to cause a portion of said second air flow to be drawn past said first heat transfer surface to effect a cooling heat transfer effect upon said first heat transfer member, the improvement comprising:

said motor being located on said first heat transfer member adjacent a side of said thermocouple structure remote from said second heat transfer member, whereby said motor does not hinder said second air flow, and is suitably located as to not be operably thermally damaged by said first heat transfer member or said heat source, and said first heat transfer member defines a motor-receiving cavity which receives said motor so as to completely surround said motor, with airflow passing through said cavity to cool said motor.

2. A fan as claimed in claim 1 wherein said cavity is an aperture having opposing opened ends.

3. A self-powered fan for circulating air in combination with a heat source having a heated surface, said fan comprising:

a base portion having a surface constructed and arranged to contact the heated surface of the heat source, a heat transfer portion extending from said base, said heat transfer portion having first and second ends, said first end being coupled to said base, a thermoelectric module having first and second end surfaces, said first end surface being mounted on said second end of said heat transfer portion such that said heat transfer portion conducts heat to said thermoelectric module, heat exchange structure mounted on said second end surface of said thermoelectric module so as to control an amount of heat conducted at the top said thermoelectric module, an electric motor electrically coupled to said thermoelectric module, and fan blades coupled to said electric motor, wherein said heat transfer portion is constructed and arranged to provide a suitable temperature gradient between said thermoelectric module and said heat source to allow sufficient heat transfer from said heat transfer portion to said thermoelectric module to generate sufficient power to said motor to effect rotation of said blades without causing thermal damage to said thermoelectric module, said fan blades being constructed and arranged relative to said base portion and heat transfer portion to cause a portion of ambient air flow to be drawn past said base portion and heat transfer portion effecting cooling of said base portion;

the improvement comprising:

said motor suitably located at said second end of said heat transfer portion adjacent said first end surface of said thermoelectric module as to not be operably thermally damaged by said heat transfer portion or said heat source and remote from said heat exchange structure whereby said motor does not hinder a portion of ambient airflow to be drawn past said heat exchange structure, and said heat transfer portion adjacent said second end defines a motor-receiving cavity, which receives said motor so as to completely surround said motor, with airflow passing through said cavity to cool said motor.

4. A fan claimed in claim 3, wherein said heat transfer portion is constructed and arranged to limit heat transfer from said base portion to said thermoelectric module such that when said heated surface is at a temperature of 500° C. or less, the temperature of said module will not exceed the operating temperature of the module or the motor.

5. A fan as claimed in claim 3, wherein said cavity is an aperture having opposing opened ends.

* * * * *